US007520390B2

(12) United States Patent
Sonon

(10) Patent No.: US 7,520,390 B2
(45) Date of Patent: Apr. 21, 2009

(54) CONFIGURABLE DISPLAY CONTAINER

(75) Inventor: James A. Sonon, Cincinnati, OH (US)

(73) Assignee: The Kroger Co., Cincinnati, OH (US)

( * ) Notice: Subject to any disclaimer, the term of this patent is extended or adjusted under 35 U.S.C. 154(b) by 725 days.

(21) Appl. No.: 11/089,523

(22) Filed: Mar. 24, 2005

(65) Prior Publication Data

US 2006/0213807 A1 Sep. 28, 2006

(51) Int. Cl.
*B65D 25/54* (2006.01)

(52) U.S. Cl. ..... 206/774; 206/766

(58) Field of Classification Search ..... 206/774, 206/772, 773, 748, 749, 45.21, 45.23, 766, 206/747, 745, 750, 759, 751
See application file for complete search history.

(56) References Cited

U.S. PATENT DOCUMENTS

| | | | | | |
|---|---|---|---|---|---|
| 409,703 | A | * | 8/1889 | Procter | 206/292 |
| 480,914 | A | | 8/1892 | Bender | |
| 489,711 | A | * | 1/1893 | Mandioni | 220/6 |
| 2,137,420 | A | | 11/1938 | Soybel | |
| 2,180,691 | A | * | 11/1939 | Olivier | 206/766 |
| D153,797 | S | * | 5/1949 | Heim | D9/629 |
| 2,616,578 | A | | 11/1952 | Dunham | |
| 2,776,083 | A | * | 1/1957 | Derman | 229/122 |
| 2,788,827 | A | * | 4/1957 | Banner | 206/553 |
| 3,307,724 | A | | 3/1967 | Miller | |
| 3,730,417 | A | | 5/1973 | Lawson | |
| 3,860,305 | A | | 1/1975 | Bergman | |
| 3,863,829 | A | * | 2/1975 | Merrill | 206/766 |
| 3,885,692 | A | | 5/1975 | Anderson, Jr. | |
| 4,211,359 | A | | 7/1980 | Chaffin | |
| 4,382,504 | A | | 5/1983 | Vesborg | |
| 4,538,953 | A | | 9/1985 | Abramson, Jr. | |
| 4,542,847 | A | | 9/1985 | Lindstrom | |
| 4,697,699 | A | | 10/1987 | Schneider | |
| 4,708,575 | A | | 11/1987 | Farmer et al. | |
| 4,726,476 | A | | 2/1988 | Smith | |
| 4,752,179 | A | | 6/1988 | Seaberg | |
| 4,809,847 | A | | 3/1989 | Schneider | |

(Continued)

OTHER PUBLICATIONS

Non-Final Office Action, mailed Dec. 28, 2007, U.S. Appl. No. 11/089,424.

*Primary Examiner*—Jacob K Ackun, Jr.
(74) *Attorney, Agent, or Firm*—Thompson Hine LLP

(57) ABSTRACT

A container for transporting articles and displaying articles includes a set of joined walls capable of forming an enclosed configuration where an interior volume is enclosed by the joined walls with each of the joined walls in their respective closed positions. The container is convertible to a display configuration where access to the interior volume is provided. The set of joined walls includes a bottom, a top moveable relative to the bottom and sides moveable relative to the bottom. In converting from the enclosed configuration to the display configuration, the top moves relative to the bottom to provide a first access opening to the interior volume and at least one side moves relative to the bottom to provide a second access opening to the interior volume. The second access opening extends from the bottom to the first access opening, and at least one other side remains in its closed position to form a first edge of the second access opening.

19 Claims, 10 Drawing Sheets

U.S. PATENT DOCUMENTS

| | | | | |
|---|---|---|---|---|
| 4,927,320 | A | | 5/1990 | Olson |
| 5,038,998 | A | | 8/1991 | Morris et al. |
| 5,450,962 | A | | 9/1995 | Uitz |
| 5,494,214 | A | | 2/1996 | Fleury et al. |
| 5,524,789 | A | | 6/1996 | Jackman |
| 5,555,975 | A | | 9/1996 | Smith |
| 5,595,304 | A | | 1/1997 | Timmins |
| 5,690,213 | A | | 11/1997 | Matsumura |
| 5,769,595 | A | | 6/1998 | Pearce et al. |
| 5,826,728 | A | | 10/1998 | Sheffer |
| 5,839,650 | A | | 11/1998 | Sheffer |
| 5,957,294 | A | | 9/1999 | Kanter |
| 6,006,918 | A | | 12/1999 | Hart |
| 6,029,886 | A | | 2/2000 | Sheffer |
| 6,056,177 | A | * | 5/2000 | Schneider ..... 224/401 |
| 6,059,514 | A | | 5/2000 | Sanchez |
| 6,131,376 | A | | 10/2000 | Grey et al. |
| 6,189,776 | B1 | | 2/2001 | Smith et al. |
| 6,209,741 | B1 | | 4/2001 | Boucher-Giles |
| 6,260,707 | B1 | * | 7/2001 | Harris ..... 206/575 |
| D466,300 | S | | 12/2002 | Walsh |
| D466,690 | S | | 12/2002 | Walsh |
| 6,516,951 | B2 | | 2/2003 | Sears et al. |
| 6,726,046 | B2 | | 4/2004 | Orset |
| 6,755,306 | B2 | | 6/2004 | Maus |
| 6,874,971 | B2 | | 4/2005 | Albaugh |
| 6,955,273 | B2 | | 10/2005 | Hartwall |
| 7,090,905 | B1 | | 8/2006 | Brauner |
| 7,175,040 | B2 | | 2/2007 | Lorenz et al. |
| D544,175 | S | | 6/2007 | Valentinsson |
| 2004/0026296 | A1 | | 2/2004 | Nesting |
| 2004/0163994 | A1 | | 8/2004 | Gardner et al. |
| 2004/0256385 | A1 | | 12/2004 | Hartwall |
| 2006/0060580 | A1 | | 3/2006 | Lorenz et al. |

* cited by examiner

CONFIGURABLE DISPLAY CONTAINER

TECHNICAL FIELD

The present application relates to containers and more particularly to a container capable of displaying objects stored therein.

BACKGROUND

In many retail enterprises, a relatively large amount of product movement is driven by a relatively small number of products. Often times, all product, both "fast moving" and non-fast moving products are shipped and handled using the same types of containers, such as cardboard boxes. The products are removed from the boxes and placed on a shelf for display and purchase. The boxes may be discarded after the product has been removed.

Display containers have been proposed that allow for both shipping and display of product stored therein. For example, a shipping carton has been proposed that can be converted into a display by removing and discarding an upper portion of the carton and folding part of the remaining lower portion under the floor of the carton to form a base for tilting the carton.

Collapsible containers have also been proposed that are capable of reducing their cubic volume by collapsing their sides. For example, a collapsible container has been proposed that includes a base and four side walls upstanding from the base. The side walls are hinged to the base so that they may occupy positions in which the side walls upstand from the base or in which they overlie the base by folding the side walls inwardly relative to the base.

SUMMARY

In an aspect, a container for transporting articles and displaying articles includes a set of joined walls capable of forming an enclosed configuration where an interior volume is enclosed by the joined walls with each of the joined walls in their respective closed positions. The container is convertible to a display configuration where access to the interior volume is provided. The set of joined walls includes a bottom, a top moveable relative to the bottom and sides moveable relative to the bottom. In converting from the enclosed configuration to the display configuration, the top moves relative to the bottom to provide a first access opening to the interior volume and at least one side moves relative to the bottom to provide a second access opening to the interior volume. The second access opening extends from the bottom to the first access opening, and at least one other side remains in its closed position to form a first edge of the second access opening.

In another aspect, a container for transporting articles and displaying articles includes a set of joined walls joined by five or more joints wherein the set of joined walls includes a bottom wall. Others of the set of joined walls are moveable relative to the bottom wall to form an enclosed configuration wherein an interior volume is enclosed and a display configuration where first and second access openings are provided to the interior volume. The interior volume is partially bounded by two or more of the joined walls with the container in the display configuration.

In another aspect, a method of enclosing articles for storage within a container and displaying articles within the container is provided. The method includes providing a container including a set of joined walls in an enclosed configuration where an interior volume is enclosed by the joined walls with each of the joined walls in their respective closed positions. The container is capable of converting to a display configuration where access to the volume is provided. The set of joined walls includes a bottom, a top moveable relative to the bottom and sides moveable relative to the bottom. A first access opening is provided to the interior volume enclosed by the container by moving the top relative to the bottom and a second access opening is provided to the interior volume by moving a first side relative to the bottom wall. The second access opening extends from the bottom to the top access opening and at least one other side remains in its closed position to form an edge of the second access opening.

The details of one or more embodiments are set forth in the accompanying drawings and the description below. Other features, objects, and advantages will be apparent from the description and drawings, and from the claims.

DETAILED DESCRIPTION

Figure 1:
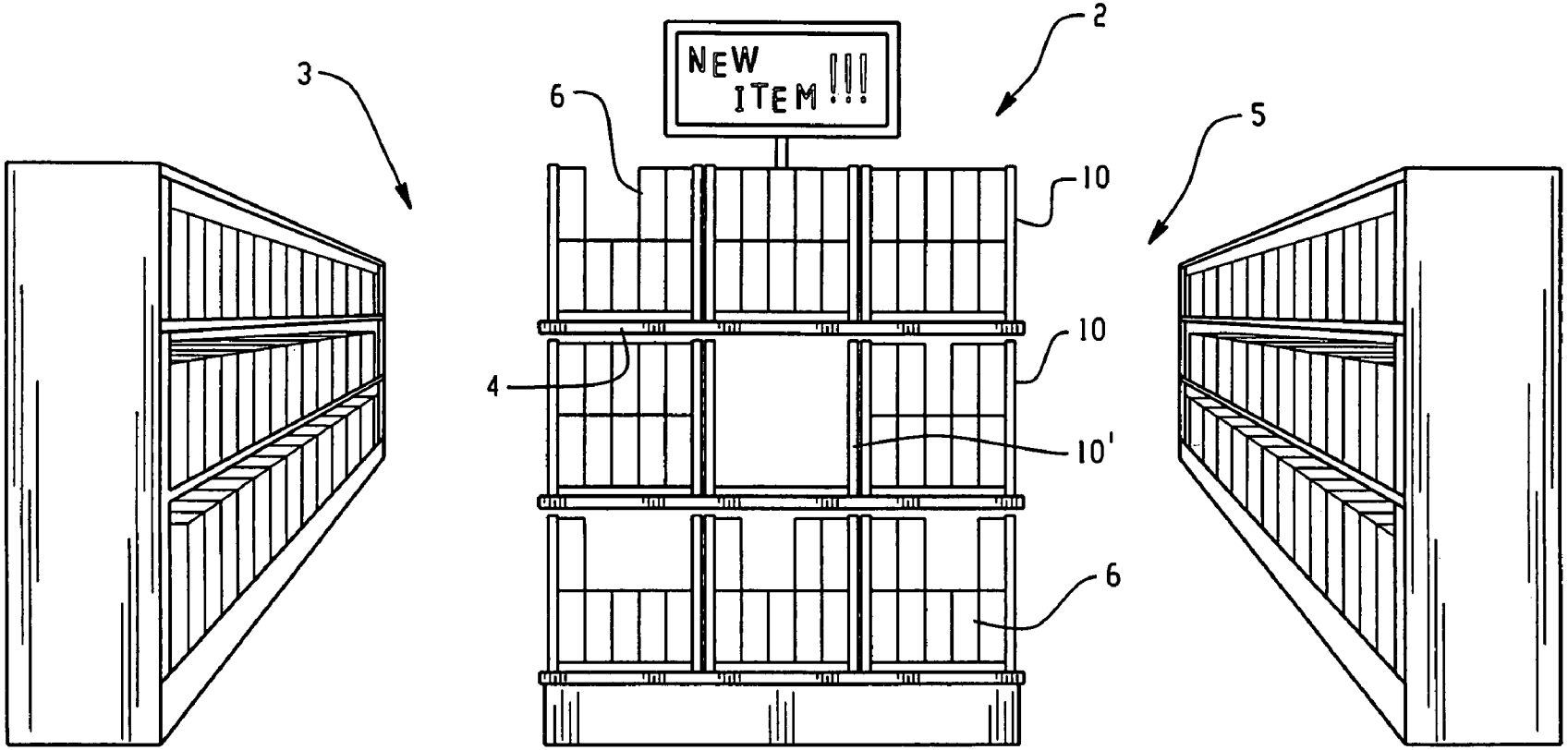
FIG. 1 is a front view of an end-aisle store display including multiple containers in their display configurations.

Referring to FIG. 1, an end-aisle store display 2 is disposed between aisles 3 and 5. The store display 2 includes multiple, display-ready containers 10 placed upon shelves 4 of the display 2. Each container 10 has a prepackaged amount of product 6 disposed therein and is capable of displaying the product 6 for customer viewing and purchase. While most of the containers 10 are illustrated as being at least partially filled with product 6, container 10' is empty because all of the product 6 disposed therein has been removed. As will be described in greater detail below, the containers 10 are configurable between an enclosed configuration, a display configuration and a collapsed configuration by a set of interconnected walls, which can facilitate transport, display, storage and removal of the containers 10.

Figure 2:
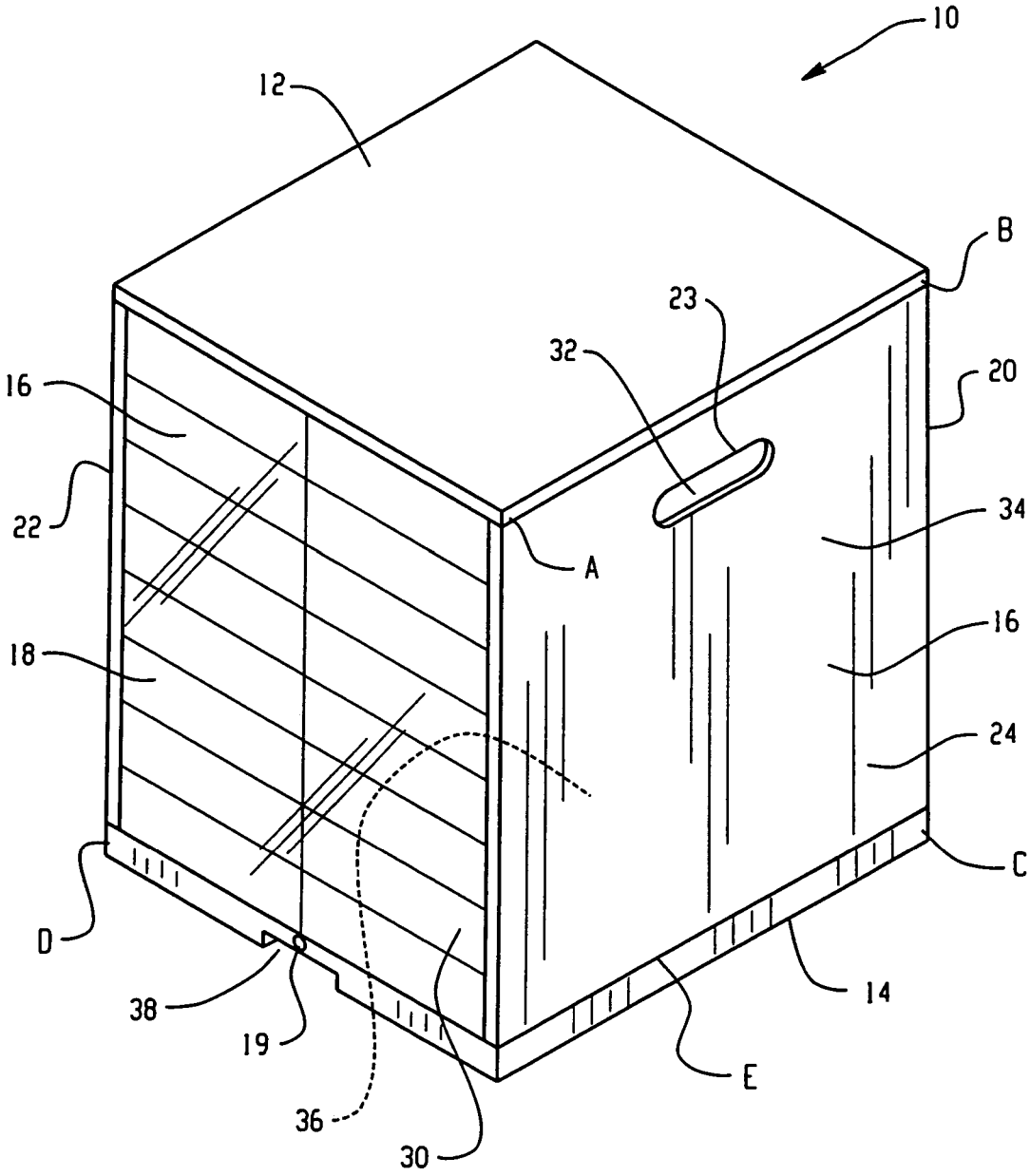
FIG. 2 is a perspective view of an embodiment of a container in an enclosed configuration.

Referring to FIG. 2, container 10 is in the enclosed configuration and includes a top wall 12, a bottom wall 14 and side walls 16 extending between the top and bottom walls. The side walls 16 include a front wall 18, a rear wall 20 and two end walls 22 and 24 extending between the front and rear walls 18, 20. The top wall 12, bottom wall 14, front wall 18, rear wall 20, and end walls 22 and 24 are interconnected by joints A-E. A lock 19 allows the front wall 18 to lock in its closed position to the bottom wall 14.

Front wall 18 is formed of a transparent material to allow for viewing of contents within the container 10 while the container 10 is in the enclosed configuration. In other embodiments, front wall 18 may not be transparent or front wall 18 may be semi-transparent. The other sidewalls 16, top wall 12 and/or bottom wall 14 may also be formed of a thermoplastic, such as a transparent, non-transparent, or semi-semi-transparent thermoplastic. A suitable transparent material includes clear plastics such as a clear polycarbonate. In some embodiments, the sidewalls 16, top wall 12 and bottom wall 14 may be formed of any other suitable materials such as food grade materials, plastics, metal, wood, etc. Lightweight materials may also be used. In some instances, container 10 has an unfilled weight of about 20 pounds or less, such as about 16 pounds.

Each end wall 22 and 24 includes a user graspable structure 32. As shown, the user graspable structures 32 are formed by an opening 33 extending through the respective end wall 22, 24 from one side 34 of the end wall 24 to the other side 36 of the end wall 24. In other embodiments, the user graspable structure 32 may not extend entirely through the end walls 22 and 24 or, for example, the graspable structure 32 may be a handle (not shown) mounted to a side 34 of the end wall 24.

Formed as part of the bottom wall 14 of the container is device engagement structure 38. The device engagement structure 38 can allow a container handling device to engage and pull the container 10 from a display or storage shelf. Additional details of the engagement structure 38 and container handling device are described in pending U.S. patent application Ser. No.11/089,429, entitled "Container Handling Apparatus and Container" and pending U.S. patent application Ser. No. 11/089,424, entitled "method for Product Handling Using a Configurable Display Container," both filed the same day as this application, the details of both of which are incorporated by reference as if fully set forth herein.

Figure 3:
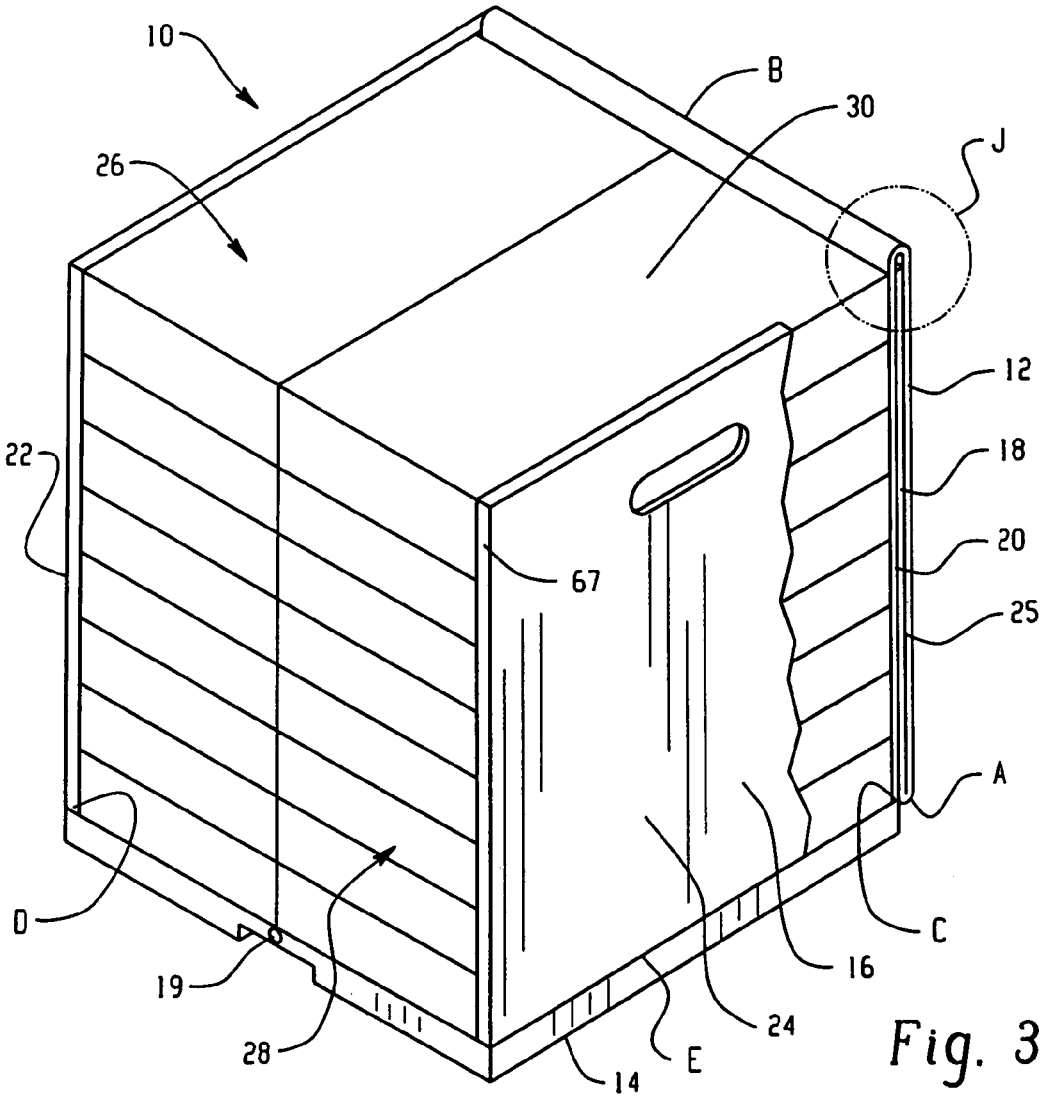
FIG. 3 is a perspective view of the container of FIG. 2 in a display configuration.

Referring to FIG. 3, the set of walls are interconnected by joints A-E to allow for movement of the top wall 12 and the side walls 16 relative to the bottom wall 14. Joint A connects front wall 18 and top wall 12 along opposing lateral edges of the front and top walls 18, 12, joint B connects top wall 12 and rear wall 20 along opposing lateral edges of the top and rear walls 12, 20 and joint C connects rear wall 20 and bottom wall 14 along opposing lateral edges of the rear and bottom walls 20, 14. As can be seen, front wall 18, top wall 12, rear wall 20 and bottom wall 14 form a bi-folding member 25 having two joints A and B that can be moved relative to the bottom wall 14 to provide access to the internal volume. Joint D connects end wall 24 and bottom wall 14 along opposing lateral edges of the end and bottom walls 24, 14, while joint E connects end wall 22 and bottom wall 14 along opposing lateral edges of the end and bottom wall 22, 14. Each of the joints A-E provides an axis of rotation between its respective joined walls that lies substantially parallel to the bottom wall 14. In alternative embodiments, pairs of the side walls 16 of the container 10 may be connected by a joint (not shown) extending along opposing vertical edges 27 of the respective pair of walls forming a respective axis of rotation that is not parallel to the bottom wall 14. In some embodiments, the axis of rotation may be about perpendicular to the bottom wall 14.

Joints A-E can be of any suitable type. However, the type of joint should be selected based, at least in part, on its rotational requirements. For example, joint A should be capable of rotating front wall 18 from its enclosed location to its location resting adjacent top wall 12 and joint B should be capable of rotating top wall 12 from its enclosed location to its location resting adjacent rear wall 20 to form bi-folding member 25. In some embodiments, joints A and B are capable of rotating about 360 degrees or less, such as about 270 degrees. Alternatively, joints C, D and E may be capable of rotating about 90 degrees or less depending on the rotational requirements. In some instances, any of the joints A-E may be capable of rotating more than 90 degrees.

Figure 4:
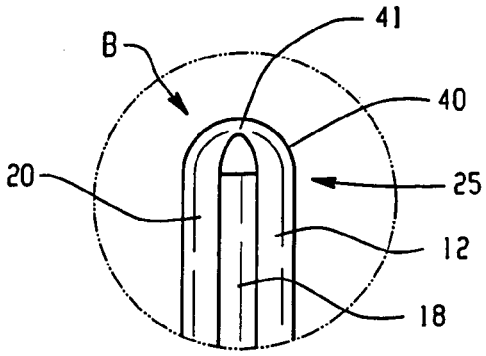
FIG. 4 is a side, detail view of an embodiment of a joint at area J of FIG. 3.
Figure 5:
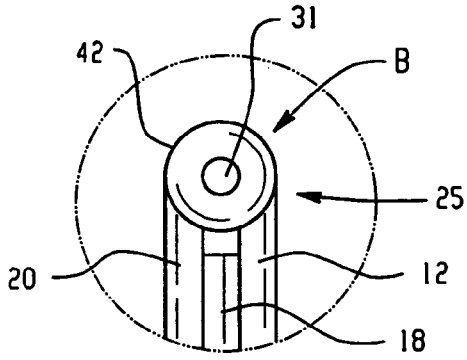
FIG. 5 is a side, detail view of another embodiment of a joint at area J of FIG. 3.

Referring to FIG. 4, joint B is a living hinge 40 formed integrally of material forming top wall 12 and front wall 18 (in some embodiments, during a molding process). Joint B can be formed of an elastic material having a weakened region 41 that facilitates folding of the top and front walls at joint B. Referring to FIG. 5, joint B is formed by a mechanical hinge 42 that interconnects the front wall 18 and the top wall 12. The mechanical hinge 42 can be mechanically connected to the front wall 18 and the top wall 12, for example, after the walls 12 and 18 are formed (e.g., by mechanical fasteners). As can be seen by both of the examples illustrated by FIGS. 4 and 5, the joint B allows for rotation of greater than 180 degrees, such as about 270 degrees. In some embodiments, the joints are formed of a food grade, corrosion resistant material.

Figure 6:
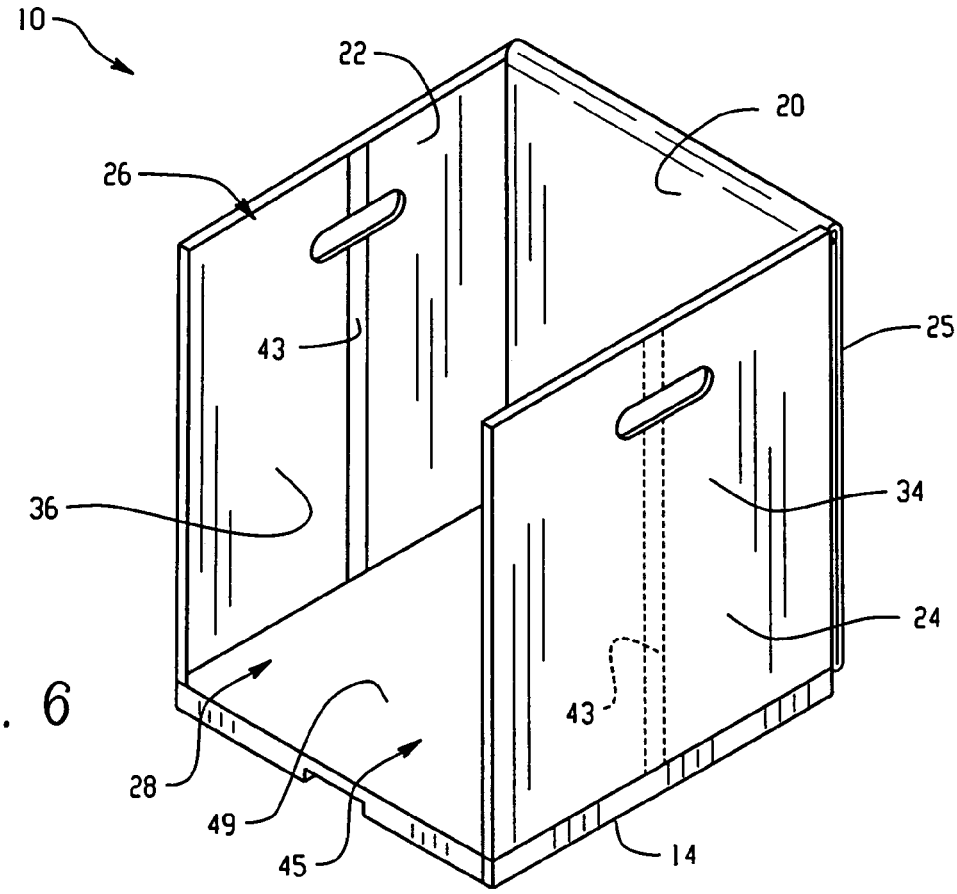
FIG. 6 is a perspective view of the container of FIG. 3 without any articles therein.

Referring now to FIG. 6, container 10 is shown in the display configuration without contents. Top access opening 26 provides access to container volume 45 through a top of the container while side access opening provides access to container volume 45 through a side of the container 10. Side access opening 28 extends uninterrupted from the bottom wall 14 to the top access opening 26 without any obstruction, such as a lip, extending into or otherwise inhibiting access to the container volume 45 through the side access opening 28. This can allow for linear, horizontal removal of articles 30 (FIG. 3) from the container 10, for example, by sliding an article along a bottom surface 49 of the container without lifting the article off of the bottom surface 49.

Top access opening 26 extends uninterrupted from rear wall 20 to side access opening 28 without any obstruction extending into or otherwise inhibiting access to the container volume 45 through top access opening 26. This can allow for linear, vertical removal of articles from the container 10 without the need for horizontal movement of the article to clear any obstruction.

Slots 43 can receive opposite side edges of an insert (not shown). The insert (e.g., a sheet of cardboard or plastic) can provide support for articles placed in the container 10. For example, it may be desirable to place an insert in the slots 43 between adjacent stacks of egg cartons placed within the container 10. The insert can reduce the potential for leaning and spilling of egg cartons through front access opening 28. When egg cartons are removed from the container 10, the insert can be seen and removed from the container 10 to expose the adjacent stack of egg cartons.

With container 10 in the illustrated display configuration, the end walls 22 and 24 are secured to rear wall 20 to maintain the container 10 in the display configuration. In some embodiments, the end walls 22, 24 and rear wall 20 are secured to each other using releasable latches that include a finger 31 (FIG. 5) that can be secured within a recess (not shown) extending inwardly from side 36 of end walls 22, 24. The latches can be released to move the end walls 22, 24 and rear wall 20 relative to bottom wall 14.

Figure 7:
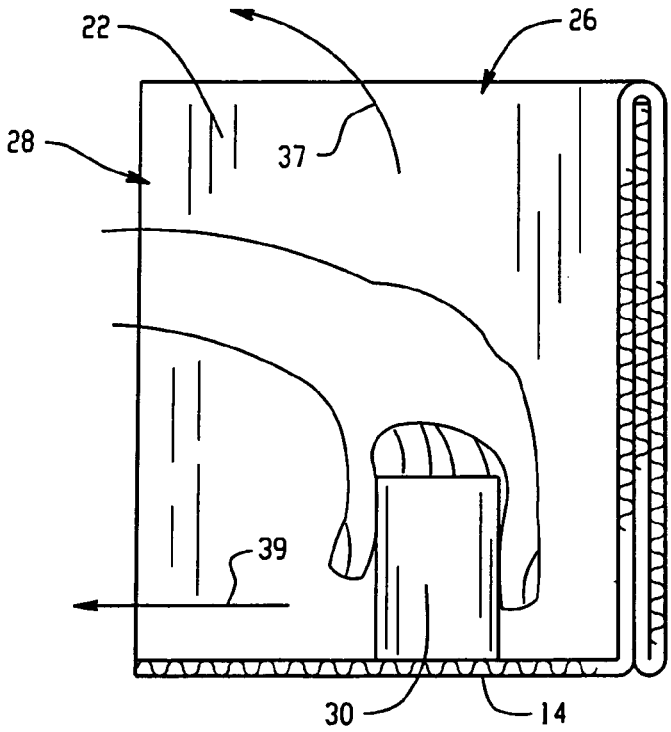
FIG. 7 is a section view of the container of FIG. 6 with an article being removed.

Referring to FIG. 7, by providing the continuous access openings 26 and 28 free of any obstructions, a user, such as a customer, can freely pick articles 30 from either the top or side of the container 10 in the directions of arrows 37 and 39 with relative ease. Additionally, when filling the container 10 with articles 30, relatively little or, in some embodiments, even no space needs to be provided within the container volume to allow for manipulation of the article to clear a lip or support member that interrupts access through the access openings when removing the article from the container 10.

Figure 8:
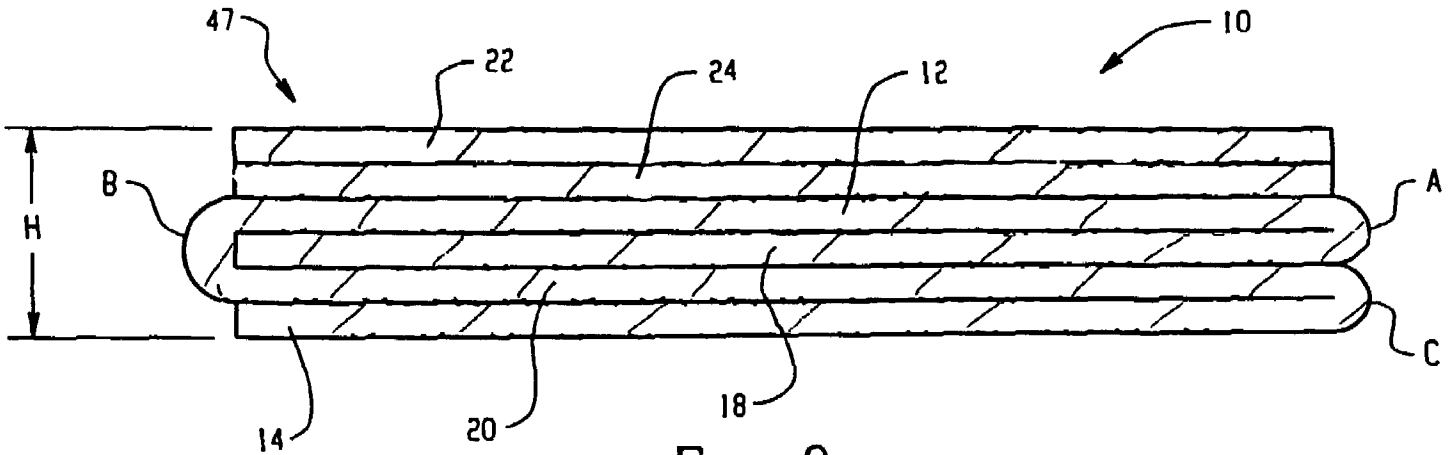
FIG. 8 is a side, section view of the container of FIG. 6 in a collapsed configuration.
Figure 9:
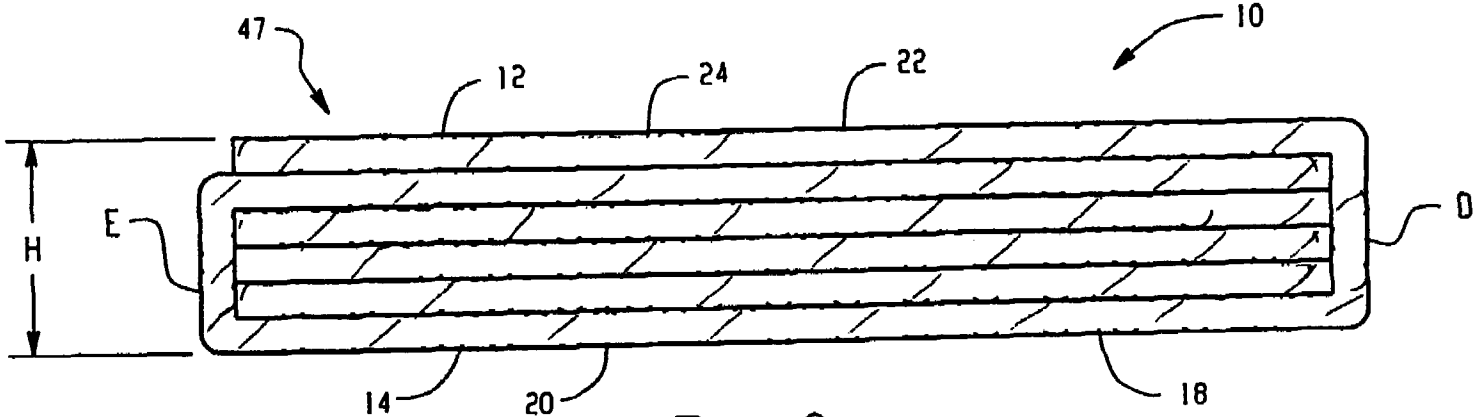
FIG. 9 is a front, section view of the container of FIG. 6 in the collapsed configuration.

Referring to FIGS. 8 and 9, side and front section views, respectively, of the container 10 in the collapsed configuration are shown. In the collapsed configuration, the walls 12, 14, 18, 20, 22 and 24 are stacked one on top of the other with end wall 22 located at the top of the stack 47 and bottom wall 14 located at the bottom of the stack 47. Each of the walls 12, 18, 20, 22 and 24 are connected to the bottom wall 14, although front wall 18 and top wall 12 are not directly connected to the bottom wall 14. Instead, referring particularly to FIG. 8, front wall 12 is connected to bottom wall 14 through top wall 12 and rear wall 20 and joints A, B and C. Referring to FIG. 9, each end wall 22 and 24 is connected directly to the bottom wall 14 through their respective joints D and E. Other variations are possible. For example, the container 10 can be constructed such that bi-fold member 25 rests on top of stack 47. In some embodiments, the container 10 collapses to a height H of between about two inches to about six inches, such as about four inches.

Figure 10A:
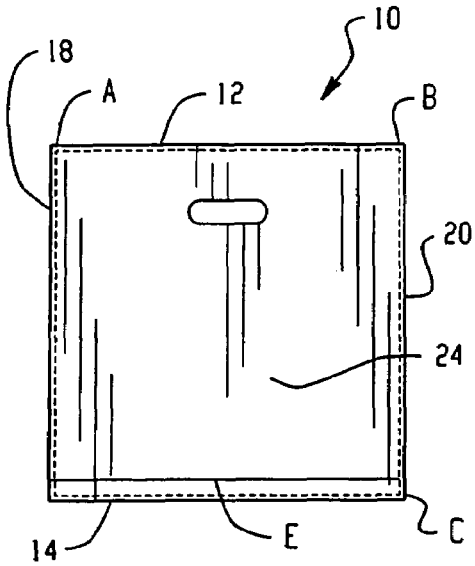
FIGS. 10A-10I illustrate a method of transforming the container of FIG. 6 between the enclosed, display and collapsed configurations.
Figure 10B:
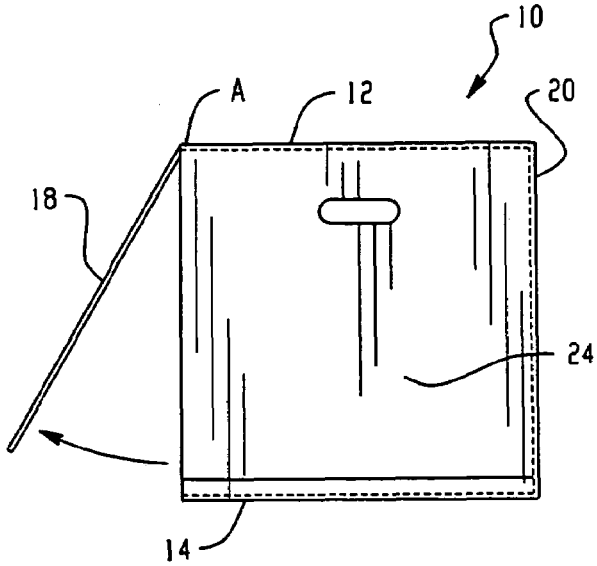
Figure 10C:
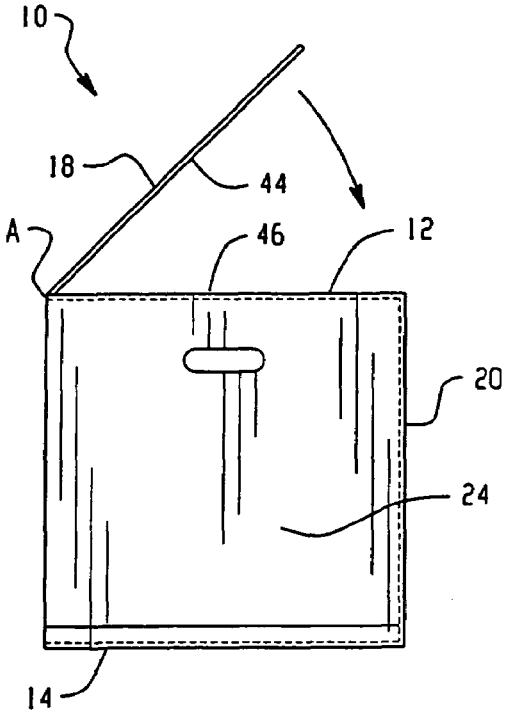
Figure 10D:
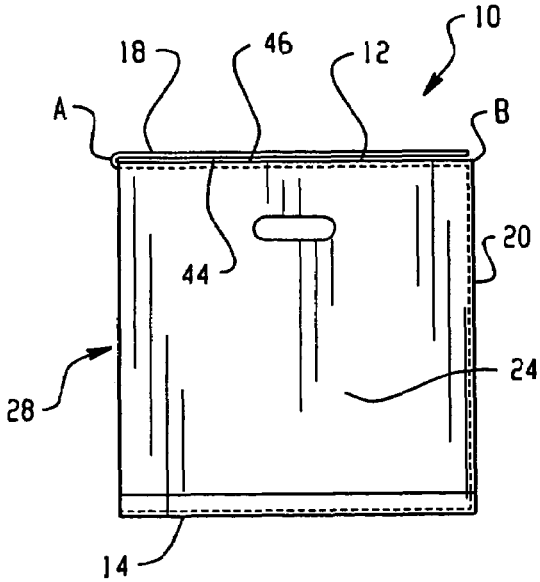

Referring to FIGS. 10A-10I, a method of reconfiguring the container 10 between the enclosed configuration (FIG. 10A), the display configuration (FIG. 10F) and the collapsed configuration (FIG. 10I) is illustrated. Referring to FIG. 10A, each of the walls 12, 14, 18, 20, 22, 24 are in their respective closed position with the container 10 in the enclosed configuration. To provide side access opening 28, front wall 18 is moved relative to the bottom wall 14 at joint A as shown by FIGS. 10B-10D. The front wall 18 can be rotated at joint A until the front wall 18 rests atop and adjacent to top wall 12 with sides 44 and 46 facing each other. With front wall 18 resting atop top wall 12, side access opening 28 is provided.

Figure 10E:
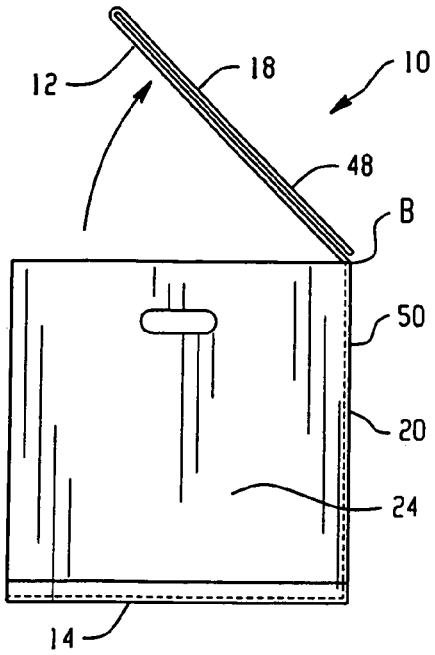
Figure 10F:
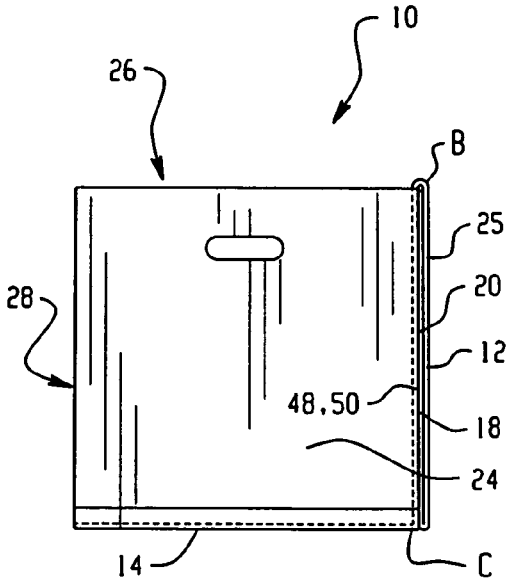

To provide top access opening 26, referring now to FIG. 10E, top wall 12 and front wall 18 are moved together relative to bottom wall 14 at joint B. Referring also to FIG. 10F, the top wall 12 and front wall 18 can be rotated at joint B until the front wall 18 rests adjacent the rear wall 20 with sides 48 and 50 facing each other as shown more clearly by FIG. 3. With front wall 18 resting adjacent rear wall 20, top access opening 26 is provided and the container 10 is in the display configuration.

Figure 10I:
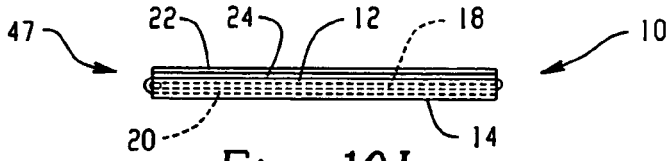
Figure 10G:
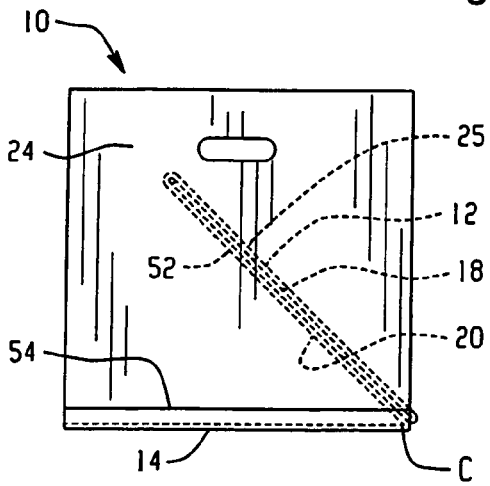
Figure 10H:
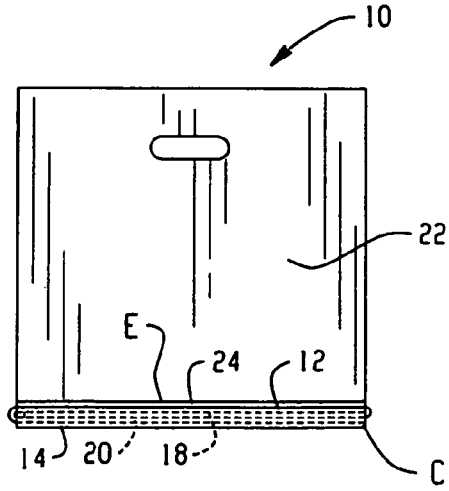

Referring now to FIG. 10G, to place the container 10 in the collapsed configuration, the bi-folded member 25 (i.e., the rear wall 20, top wall 12 and front wall 18) is moved relative to the bottom wall 14 at joint C. Referring also to FIG. 10H, the bi-folded member 25 can be rotated at joint C until the rear wall 20 rests atop and adjacent the bottom wall 14 with sides 52 and 54 facing each other. Referring to FIG. 10I, the end walls 22 and 24 are rotated about their respective axes D and E until they each rest on top of stack 47 forming the collapsed configurations described above with reference to FIGS. 8 and 9. The above-described method can performed in reverse to convert the container 10 from the collapsed configuration to the display and enclosed configurations.

Although the walls 12, 14, 18, 20, 22, 24 are moveable due to joints A-E, as noted above, the end walls 22, 24 and rear wall 20 can be secured in their respective closed positions as shown by FIG. 10F, for example, using latches or other releasable securing structure (not shown) capable of securing the end walls 22, 24 to the rear wall 20. With the securing structure, the container 10 can be locked in the enclosed configuration. In some embodiments, other of the walls 12, 14, 18 may be secured in a respective closed position.

Container 10 can be formed to accommodate any desired number, size, shape and weight of article 30. In some embodiments, the container 10 may have a rated capacity of between about 100 and 500 pounds of product, such as up to about 180 pounds or up to about 250 pounds. The container can be any desired size including having external dimensions of between about 10 inches and about 40 inches in width such as about 24 inches in width, between about 10 inches and about 40 inches in depth such as about 21 inches in depth, and between about 10 inches and 40 inches in height such as about 23 inches in height. The container can have internal dimensions of between about 10 inches and about 40 inches in width such as about 23 inches in width, between about 10 inches and about 40 inches in depth such as about 20 inches in depth, and between about 10 inches and 40 inches in height such as about 20 inches in height. End walls 22 and 24 may be any desired thickness. In some embodiments, the end walls 22, 24 may be about ¾ inch or less, such as about ½ inch.

Figure 11:
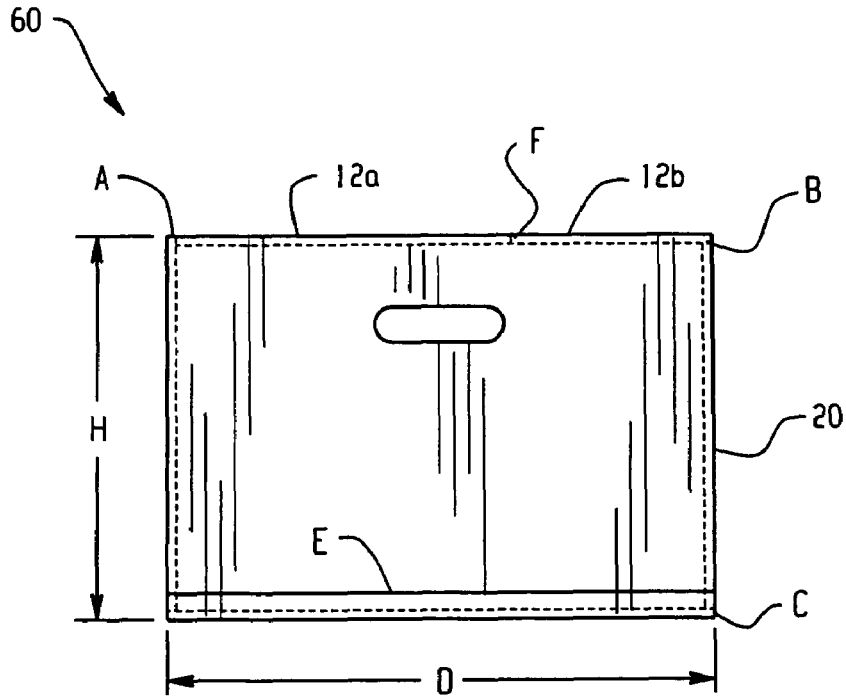
FIG. 11 is a side view of an alternative embodiment of a container.
Figure 12:
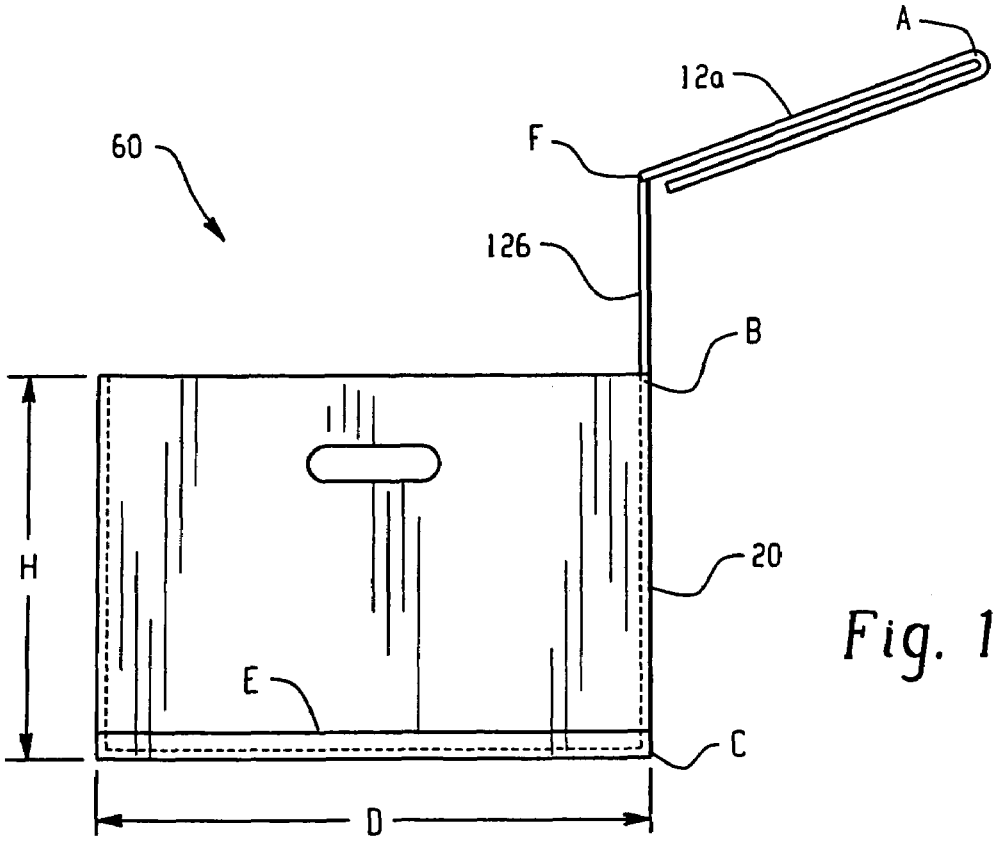
FIG. 12 is a side view of the container of FIG. 11 with its top and front wall moved toward the display configuration.

In another embodiment, a container 60 may have a depth D that is greater than its height H. Referring to FIG. 11, container 60 includes the features of container 10 with the addition of an added joint F at top wall 12. Referring to FIG. 12, the joint F provides a pivot between top wall sections 12*a* and 12*b* to allow top wall section 12*a* to rest adjacent the rear wall 20 in the display configuration without extending below the bottom wall 14. Container 60 can have external dimensions of between about 8 inches and 15 inches in width, such as about 12 inches in width, between about 8 inches and 15 inches, such as about 13 inches in height, and between about 12 inches and 24 inches in depth, such as about 23 inches in depth.

The above-described containers can be used at any desired type of facility including warehouses, club stores, retail stores, etc. For example, in the illustrated embodiments, containers 10 and 60 may be used at a grocery store, supermarket, super center, convenience mart, etc., where product is stored at a storage location that is removed from a retail location. The containers 10, 60 can be sized and configured to be placed directly on a display shelf in their respective display configurations without any need for removing and/or adding product.

In some instances, it may be desirable to fill container 10, 60 with "fast moving" items, such as eggs, for example, at a production facility. By "fast moving" items, we mean that relatively small percentage of items that drive a relatively large percentage of product movement from the storage location to the retail location for consumer purchase. The containers 10, 60 can be filled at the production facility, shipped to the retail location and then placed directly on the shelf in their respective display configurations. Empty containers 10, 60 can be collapsed and removed from their associated displays and then transported back to the production facility for refilling. Examples of fast moving items include, for example, sale items, dairy products, soft drinks, certain baked goods such as muffins, certain bagged produce such as bagged fruit and vegetables, certain granular products such as corn meal and flower, eggs, bottled water, etc.

By using container 10, 60, a user can move more product to the shelf than could be done manually in a single run. In some instances, it may be desirable to fill container 10, 60 with certain items (e.g., promotional and seasonal items) at a regional distribution or consolidation center. Container 10, 60 may also be well-suited for handling bagged products such as cat litter, pet food, sugar, etc. by providing additional protection against bag rupture as the product is being placed on a display for purchase.

Figure 13:
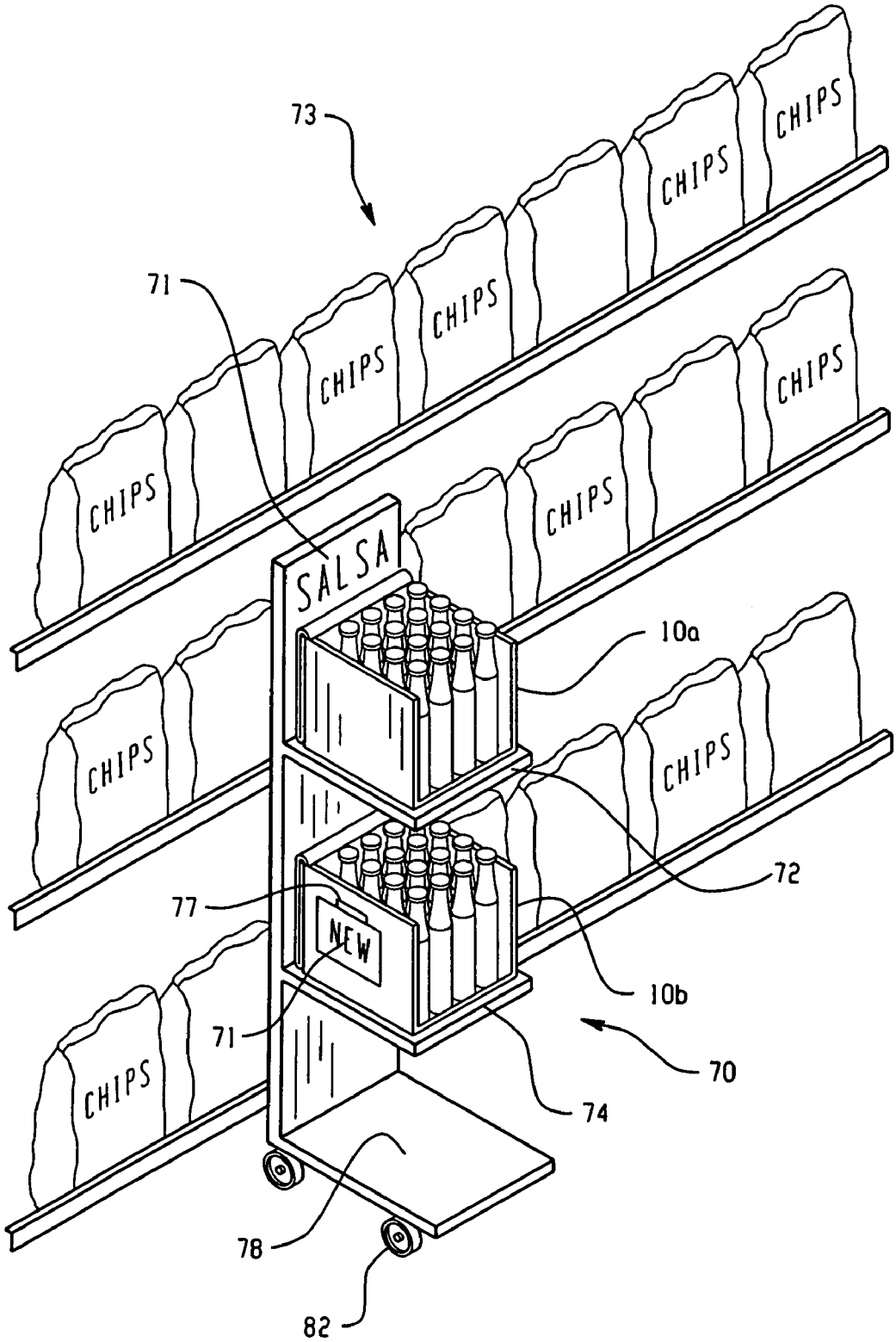
FIG. 13 is a perspective view of an embodiment of a wing display.

Referring now to FIG. 13-16, the above-described containers 10, 60 can be used in conjunction with in-store displays. FIG. 13 illustrates an example of an aisle display 70 that includes two containers 10*a* and 10*b*. Container 10*a* rests on an upper shelf 72 (e.g., between about three feet and about five feet, such as about four feet from the ground) that allows for placement of the container 10*a* the customer's eye level. Container 10*b* is rests on a lower shelf 74 that is spaced from the ground (e.g., between about one foot to about three feet, such as about two feet), for example, to reduce the amount of bending user 76 must do to reach an item supported on the lower shelf 74. The aisle display 70 includes a base 78 and wheels 82 that allow for re-positioning of the aisle displays, e.g., in the store. In some instances, the aisle display 70 or container 10*a*, 10*b* may accept signage 71 or graphics that can convey a brand or "Great Price!" message. The container 10*a*, 10*b* may include an attachment 77 to which signage can be clipped or otherwise attached to. The aisle display 70 can be used, for example, to reinforce value pricing to price-sensitive shoppers and/or to place supplemental inventory in aisles 73 in support of promotional pricing.

Figure 15:
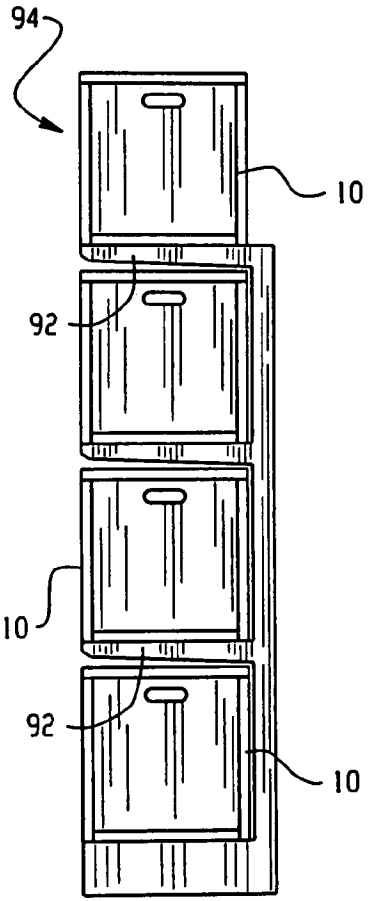
FIG. 15 is a side view of an embodiment of an one-sided.
Figure 14:
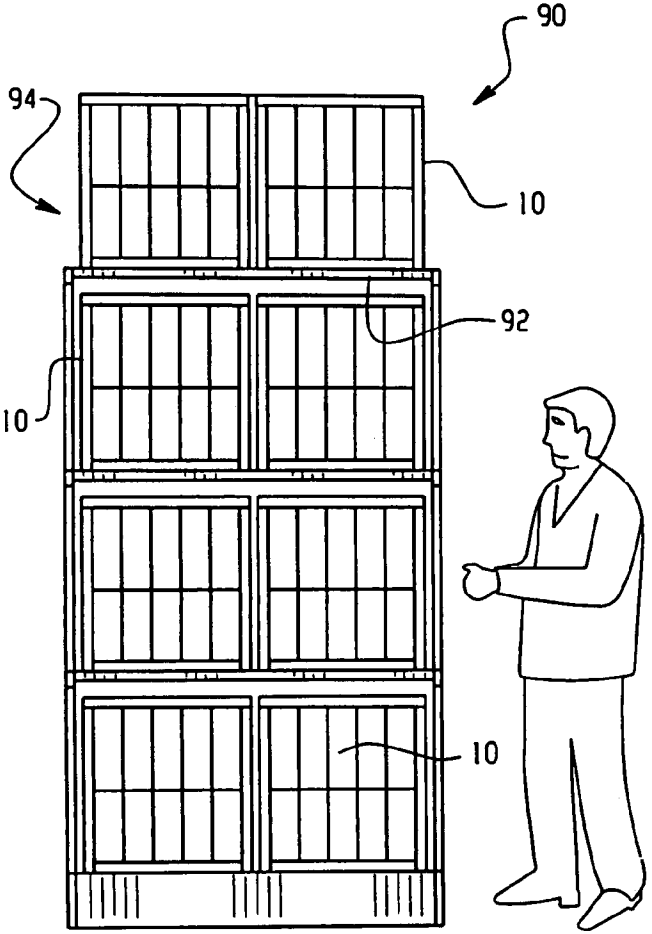
FIG. 14 is a front view of an embodiment of a display.

Referring now to FIGS. 14 and 15, a single-sided display 90 includes multiple containers 10 resting on shelves 92. Display 90 may be suitable as an end-aisle display or as a seasonal display. Display 90 includes an uppermost, backstock level 94 that can be used to restock a lower level once all product is moved from a particular container 10 placing a replacement container 10 full of product within relatively close proximity to an empty container 10. Once all product is removed from a particular container 10, the container 10 can be placed in the collapsed configuration as previously described and removed from the display 90. A replacement container 10 can be removed from the backstock level 94 and placed at the empty container's location on the display 90.

Figure 16:
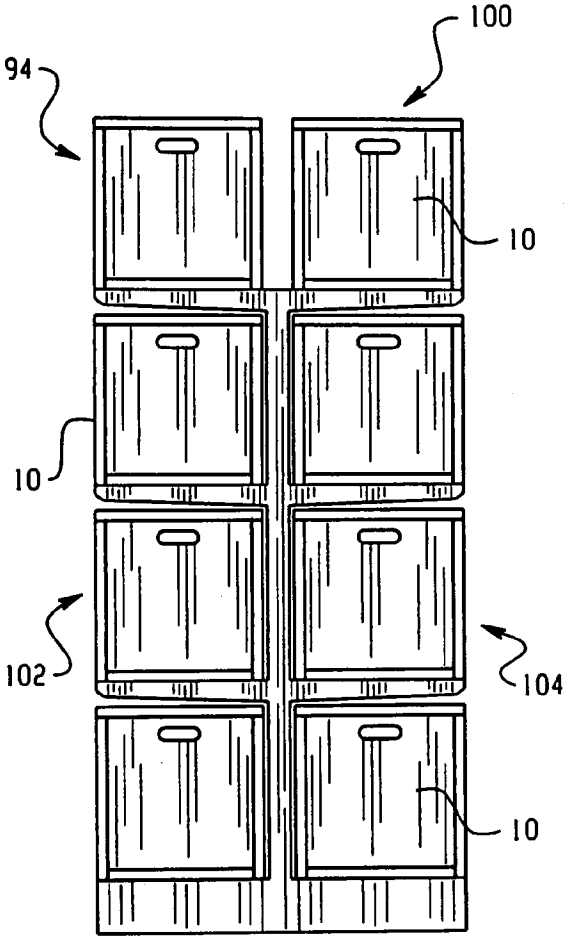
FIG. 16 is a side view of an embodiment of a two-sided display.

Referring to FIG. 16, an alternative embodiment of FIG. 14 is a two-sided display 100 that includes a front side 102 and a back side 104, each of the sides 102 and 104 including containers 10. The two-sided display may be suitable for, e.g., soft drinks, bottled water, bagged potatoes and/or onions. It can be used across adjacent aisles or in open spaces within a store.

Where containers 10, 60 are used with in-store displays, such as those described above, it may be desirable to size the container 10, 60 to achieve a desirable viewing position for product within the container 10, 60. Additionally, in some embodiments, the containers 10, 60 are black in color, which can minimize the presence of the containers 10, 60 to consumers, which can emphasize the product. Alternatively, the containers 10, 60 may be any other suitable color such as red, white, blue, green, yellow, or any combination of the primary colors. In some instances, it may be desirable to match the container 10, 60 color with a store display color or for consistency with colors associated with a particular holiday, such as Christmas, Valentine's Day, Easter, Halloween, Thanksgiving, etc.

Containers 10, 60 can be used in non-retail applications. For example, it may be advantageous to use containers 10, 60 for a picking operation, for example, in an assembly process. The containers 10, 60 may contain items used for assembly at a particular station, such as mechanical fasteners, electrical components, etc. Containers 10, 60 may also be suitable for use in picking operations, such as to fill pharmaceutical orders where containers 10, 60 hold pre-selected quantities of a drug that can be selected by a pharmacist to fill an order.

A number of detailed embodiments have been described. Nevertheless, it will be understood that various modifications may be made. For example, the containers 10 and 60 may include pallet structures, e.g., at the bottom of the containers, that allow a transport device, such as a forklift, to engage an underside of the container to lift the container from a shelf or off the ground. Additionally, the containers 10 and 60 may include stacking structures, such as ribs extending from the underside of the containers and mating grooves formed in the tops of the containers. The stacking structures can provided added stability when the containers are stacked one on top of the other. In some instances, the containers 10, 60 may have end walls and a rear wall that are fixed relative to the bottom wall where only the front wall and top wall are moveable relative to the bottom wall. Accordingly, other embodiments are within the scope of the following claims.

What is claimed is:

1. A container for transporting articles and displaying articles, the container comprising:

a set of joined walls formed of a rigid, plastic material and configured to form a rectangular box-shaped enclosed configuration where an interior volume is enclosed by the joined walls with each of the joined walls in their respective closed positions and the container is convertible to a display configuration where access to the interior volume is provided, the set of joined walls including a bottom;

a top configured to move relative to the bottom; and sides configured to move relative to the bottom;

where in converting from the enclosed configuration to the display configuration the top is configured to move relative to the bottom to provide a first access opening to the interior volume, at least one side is configured to move relative to the bottom while remaining connected to the top to provide a second access opening to the interior volume extending from the bottom to the first access opening, and at least one other side remains in its closed position to form a first edge of the second access opening;

wherein the sides include a front, a back opposite the front and first and second ends extending between the front and the back;

hinges that connect the set of joined walls, the front being joined to the top by a hinge, the top being joined to the back by a hinge and the first and second ends being joined to the bottom by a respective hinge;

wherein the top, the front, the back, the first end and the second end are configured to move relative to the bottom to form a collapsed configuration where the top, the front, the back, the first end and the second end are folded over the bottom to form a layered stack of walls.

2. The container of claim 1, wherein the front moves relative to the bottom to provide the second access opening, the first and second ends remaining in their respective closed position such that the second end forms the first edge of the second access opening and a first top edge of the first access opening with the container in the display configuration and the first end forms a second edge of the second access opening and a second top edge of the first access opening with the container in the display configuration.

3. The container of claim 1, wherein the first and second ends are releasably secured to the back with the container in the display configuration.

4. The container of claim 1, wherein the front, top and back are connected to form a bi-folding member that is moveable relative to the bottom to form the first and second access openings.

5. The container of claim 1, wherein the hinges form a respective pivot axis that is substantially parallel to the bottom.

6. The container of claim 1, wherein the front comprises a transparent material such that the interior volume is viewable to a user from outside the container with the container in the enclosed configuration.

7. The container of claim 6, wherein the transparent material comprises polycarbonate.

8. The container of claim 1 further comprising a lock configured to lock the front to the bottom with the container in the enclosed configuration.

9. The container of claim 1, wherein one or more of the sides are black in color.

10. The container of claim 1 further including user graspable structure located at one or more of the sides.

11. The container of claim 1, wherein the second access opening extends uninterrupted from the bottom to the first access opening without any obstruction inhibiting access to the interior volume through the second access opening with the container in the display configuration.

12. The container of claim 11, wherein the first access opening extends uninterrupted from a side opposite the second access opening to the second access opening without any obstruction inhibiting access to the interior volume through the first access opening with the container in the display configuration.

13. A container for transporting articles and displaying articles, the container comprising:

a set of joined wails joined by five or more joints wherein the set of joined walls includes a bottom wall;

wherein others of the set of joined wails are moveable relative to the bottom wall to form a rectangular box-shaped enclosed configuration wherein an interior volume is enclosed and a display configuration wherein first and second access openings are provided to the interior volume, the interior volume being partially bounded by two or more of the joined walls in the display configuration;

wherein the set of joined walls includes a first side wall joined to a top wall by a first joint of the five or more joints;

a second side wall joined to the top wall by a second joint of the five or more joints, the second wall being joined to the bottom wall by a third joint of the five or more joints;

a third side wall joined to the bottom wall by a fourth joint of the five or more joints; and a fourth side wall joined to the bottom wall by a fifth joint of the five or more joints;

wherein the first side wall moves relative to the bottom wall to provide the second access opening and the top wall moves relative to the bottom wall to provide the first access opening;

wherein the second access opening extends uninterrupted from the bottom wall to the first access opening without any obstruction inhibiting access to the interior volume through the second access opening with the container in the display configuration.

14. The container of claim 13, wherein the first access opening extends uninterrupted from the second side wall to the second access opening without any obstruction inhibiting access to the interior volume through the first access opening with the container in the display configuration.

15. The container of claim 13, wherein at least one of the five or more joints provides a pivot axis that is substantially parallel to the bottom wall.

16. The container of claim 13 comprising six joints joining the set of joined walls.

17. The container of claim 13, wherein the set of joined walls includes a bi-folding member.

18. The container of claim 16 including only six joints, wherein the sixth joint divides the top wall into first and second top wall sections such that the first top wall section pivots relative to the second top wall section while remaining joined thereto, the first top wall section being joined to the first side wall by the first joint, the second top wall section being joined to the second side wall by the second joint, the top wall having a length that is greater than a height of the side walls.

19. A method of enclosing articles for storage within a container and displaying articles within the container, the method comprising:

providing a container including a set of joined walls in a rectangular box-shaped enclosed configuration where an interior volume is enclosed by the joined walls with each of the joined walls in their respective closed positions, the container capable of converting to a display configuration where access to the volume is provided, the set of joined walls including a bottom, a top configured to move relative to the bottom and sides configured to move relative to the bottom;

placing the container in the display configuration by providing a first access opening to the interior volume enclosed by the container by moving the top relative to the bottom and providing a second access opening to the interior volume by moving a first side relative to the bottom wall, the second access opening extending from the bottom to the top access opening, wherein at least one other side remains in its closed position to form an edge of the second access opening; and placing the container in a collapsed configuration by folding the sides and the top on the bottom with the set of walls joined forming a layered stack of walls;

wherein the top and the first side are pivotally joined such that the first side is configured to move relative to the top while remaining joined thereto, the top is pivotally joined to a second side such that the top is configured to move relative to the second side while remaining joined thereto and the second side is pivotally joined to the bottom such that the second side is configured to move relative to the bottom while remaining joined thereto;

wherein the second access opening extends uninterrupted from the bottom to the top access opening without any obstruction inhibiting access to the interior volume through the second access opening with the container in the display configuration;

wherein the first access opening extends uninterrupted from a second side opposite the second access opening to the second access opening without any obstruction inhibiting access to the interior volume through the first access opening with the container in the display configuration.

* * * * *

UNITED STATES PATENT AND TRADEMARK OFFICE

CERTIFICATE OF CORRECTION

PATENT NO. : 7,520,390 B2
APPLICATION NO. : 11/089523
DATED : April 21, 2009
INVENTOR(S) : James A. Sonon It is certified that error appears in the above-identified patent and that said Letters Patent is hereby corrected as shown below:

Claim 13, Col. 9, Line 34

Replace "...wails…" with -- walls --

Signed and Sealed this

Fourteenth Day of July, 2009

JOHN DOLL
*Acting Director of the United States Patent and Trademark Office*